US005265999A

United States Patent [19]

Wenschhof et al.

[11] Patent Number: 5,265,999

[45] Date of Patent: Nov. 30, 1993

[54] APPARATUS FOR HANDLING ROLLS OF WEB MATERIAL

[75] Inventors: David E. Wenschhof, Victor; Fred M. Fuss, Hamlin; Gerald C. Pagorek, Holcomb; Judith B. Scott, Rochester, all of N.Y.

[73] Assignee: Eastman Kodak Company, Rochester, N.Y.

[21] Appl. No.: 847,154

[22] Filed: Mar. 5, 1992

[51] Int. Cl.[5] ..... B65H 1/00

[52] U.S. Cl. ..... 414/226; 414/908; 414/910; 242/58.6; 242/81

[58] Field of Search ..... 414/225, 226, 739, 910, 414/911, 908, 27; 242/41, 58.6, 81; 294/116, 115, 88, 81.61; 901/36, 39

[56] References Cited

U.S. PATENT DOCUMENTS

| | | | |
|---|---|---|---|
| 2,693,901 | 11/1954 | Olson et al. | 294/116 X |
| 3,212,650 | 10/1965 | Sharpe et al. | 214/1 |
| 3,258,136 | 6/1966 | Rockstrom et al. . | |
| 4,135,674 | 1/1979 | Bartmann . | |
| 4,153,211 | 5/1979 | Lenk et al. | 242/41 X |
| 4,364,706 | 12/1982 | Kranzlmuller | 414/911 X |
| 4,591,106 | 5/1986 | Gay | 242/41 X |
| 4,709,870 | 12/1987 | Veith et al. | 242/68 |
| 4,810,019 | 3/1989 | Brucher | 294/106 |
| 5,031,381 | 7/1991 | Focke | 242/58.6 X |

OTHER PUBLICATIONS

0194233, European Patent Application, Sep.-1986.

*Primary Examiner*—Michael S. Huppert
*Assistant Examiner*—Donald W. Underwood
*Attorney, Agent, or Firm*—Charles E. Snee, III

[57] ABSTRACT

Apparatus is disclosed for handling rolls (12) of web material, the rolls being of the type having a hollow core (60) on which a length of the web is wound, the core having opposite ends (68) extending axially beyond the material. The rolls are supported on a rack (10) with their axes of rotation essentially horizontal. Devices such as a general purpose programmable robot (22) having a special tool (26, 32–114) are provided for removing rolls from the rack and placing them on a transfer stand (28, 116–174) adjacent a processing apparatus (30). The transfer stand extends toward the processing apparatus and pushes a fresh roll from its chuck (174) onto the chuck (186) of the processing apparatus.

13 Claims, 7 Drawing Sheets

APPARATUS FOR HANDLING ROLLS OF WEB MATERIAL

TECHNICAL FIELD

The invention relates to apparatus for transferring rolls of web material to and from an apparatus for processing the web. More particularly, the invention is concerned with apparatus for removing such a roll from a storage stand, delivering the roll to the processing apparatus and then removing the empty core of the roll from the processing apparatus. Alternatively, following rewinding of the roll after processing, the invention is concerned with returning the processed roll to storage. The invention finds particular utility in the handling of large rolls of photographic film.

BACKGROUND ART

Various devices are known for moving objects such as rolls of material or similar cylindrical or annular shaped objects. U.S. Pat. No. 3,212,650 shows an apparatus for unloading annular articles from a processing apparatus such as a machine tool, in which a cylinder actuates a linkage to close a pair of pivoted gripping arms about the article. U.S. Pat. No. 4,709,870 discloses an apparatus for supporting a large roll of cloth by its winding shaft, in which keeper rollers are moved aside to permit the apparatus to engage the shaft and then pivoted back beneath the shaft to permit the apparatus to support the shaft as it rotates. U.S. Pat. No. 4,810,019 discloses a type of collet chuck including a pair of linkages actuated by a cylinder to grasp cylindrical objects of various diameters.

Apparatus of the types shown in these patents are generally not suitable for handling rather large rolls of delicate web material such as 35 mm photographic film. Such rolls may comprise a length of film of several thousand feet and must be handled with care to prevent the convolutions of the roll from shifting axially and to avoid contact of the roll with objects which might damage the film. Because of these concerns about the film, such rolls commonly are manually loaded onto and removed from various processing apparatus, such as perforators and spoolers. To ease the burden on the persons handling such rolls, the weight of the rolls is controlled by limiting the length of the film. While such limits are considered necessary for manual handling to avoid injuries to workers as well as damage to the film, the throughput to the processing apparatus is hampered severely by the requirement to use small rolls. Thus, a need has existed to eliminate the job of manual handling by providing automatic apparatus capable of lifting much heavier and larger rolls of film, placing such rolls on the processing apparatus and removing them after processing, all without incurring damage to the film.

SUMMARY OF THE INVENTION

In accordance with a preferred embodiment of the invention, automatic handling of such rolls is provided by an apparatus which includes means such as a rack for supporting a plurality of the rolls with their axes of rotation essentially horizontal and the ends of the hubs of the hollow cores of the rolls closely spaced. A first stand is provided having a first chuck for engagement with the hollow core. A second stand, which is comprised in the processing apparatus for the web material, is provided with a second chuck axially aligned with and facing the first chuck. Means such as a general purpose programmable robot with a special tool are provided for gripping a roll at the support rack by engaging the opposite ends or hubs of its core, lifting the roll from the support rack and placing the roll on the first chuck. The first stand is provided with means for moving the first chuck and the roll supported thereon toward the second chuck and then for pushing the roll axially from the first chuck onto the second chuck.

The tool for the robot preferably comprises first and second elongated side frames each having an upper and a lower end, with means connected between the upper ends to define an elongate space between the side frames for receiving a roll. A first pair of opposed gripper arms is pivotably mounted to the lower end of the first side frame and a second pair is mounted to the lower end of the second side frame. Means such as a pair of coil springs are provided for resiliently biasing the gripper arms on each side frame to move the arms out of engagement with the core of a roll. Each side frame supports an actuator for forcing its pair of gripper arms to pivot into engagement with the core of a roll. A common means, such as a pneumatic cylinder, is provided for operating the actuators on both side frames to move the gripper arms against the action of the springs and into engagement with the core of a roll. In the preferred embodiment, the gripper arms are provided with cam surfaces and the actuators each comprise a carriage which moves on tracks on the side frame, the carriage supporting cam followers which engage the cam surfaces as the carriage is moved by the pneumatic cylinder. The pair of coil springs biases the cam surfaces against the cam followers.

DESCRIPTION OF THE PREFERRED EMBODIMENTS

Figure 1:
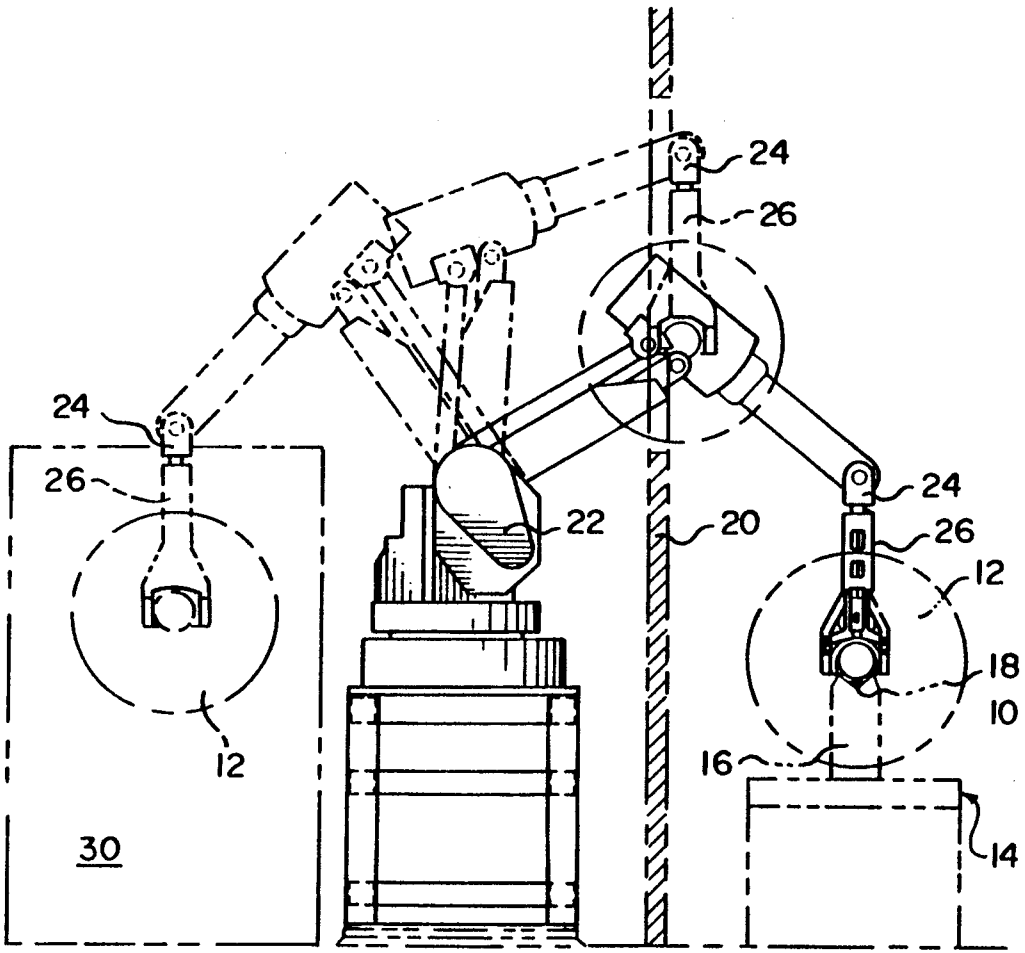
FIG. 1 illustrates schematically an elevation view of a robotic system for handling large rolls of web material in accordance with the invention.

The following is a detailed description of the preferred embodiments of the invention, reference being made to the drawings in which the same reference numerals identify the same elements of structure in each of the several Figures.

Figure 2:
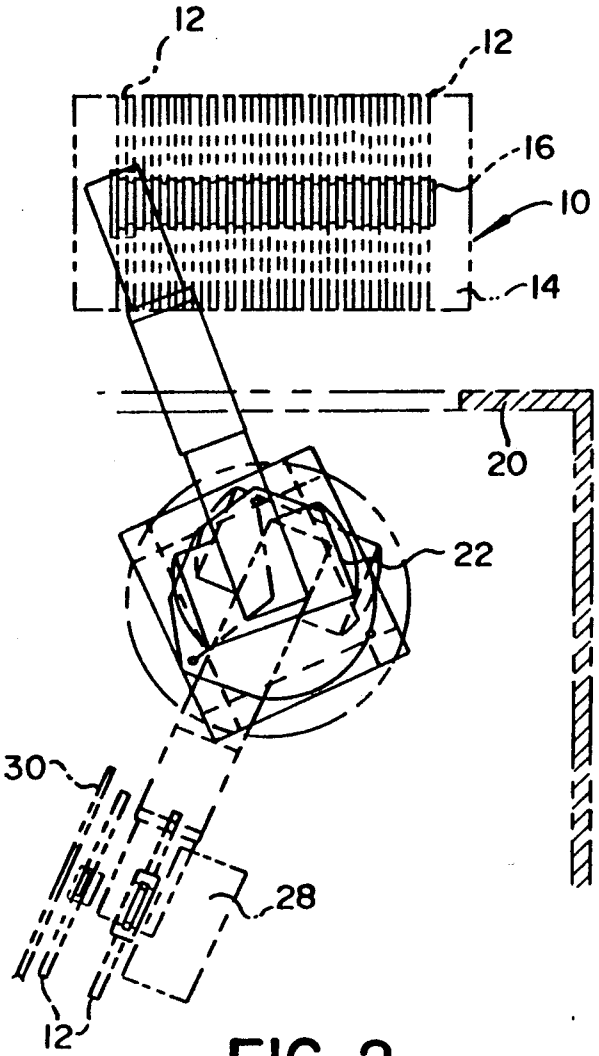
FIG. 2 illustrates schematically a top view of the system of FIG. 1.

FIGS. 1 and 2 illustrate the overall arrangement of the apparatus of the invention. A rack 10 is provided for supporting a plurality of large rolls 12 of web material such as 35 mm photographic film. The rolls are supported on rack 10 with their axes of rotation generally horizontal. In the case of 35 mm film, as many as nineteen or so rolls may be supported on rack 10 and the rolls may be from 8.5 inches (21.59 cm) in diameter up to the maximum diameter which can be carried by rack 10 and handled by the associated robot. The weight of such rolls is limited only by the capacity of the robot. Rack 10 comprises a base 14 which may be mounted on a suitable vehicle, not illustrated. Extending upwardly from base 14 are a plurality of upright, parallel support plates 16, one more in number than the number of rolls to be supported, only one of which is visible in FIG. 1. Each support plate 16 comprises at its upper end a cradle 18 having an axial width sufficient to enable the cradle to support the end hubs of the cores of two adjacent rolls 12, as indicated schematically in FIG. 4.

Figure 3:
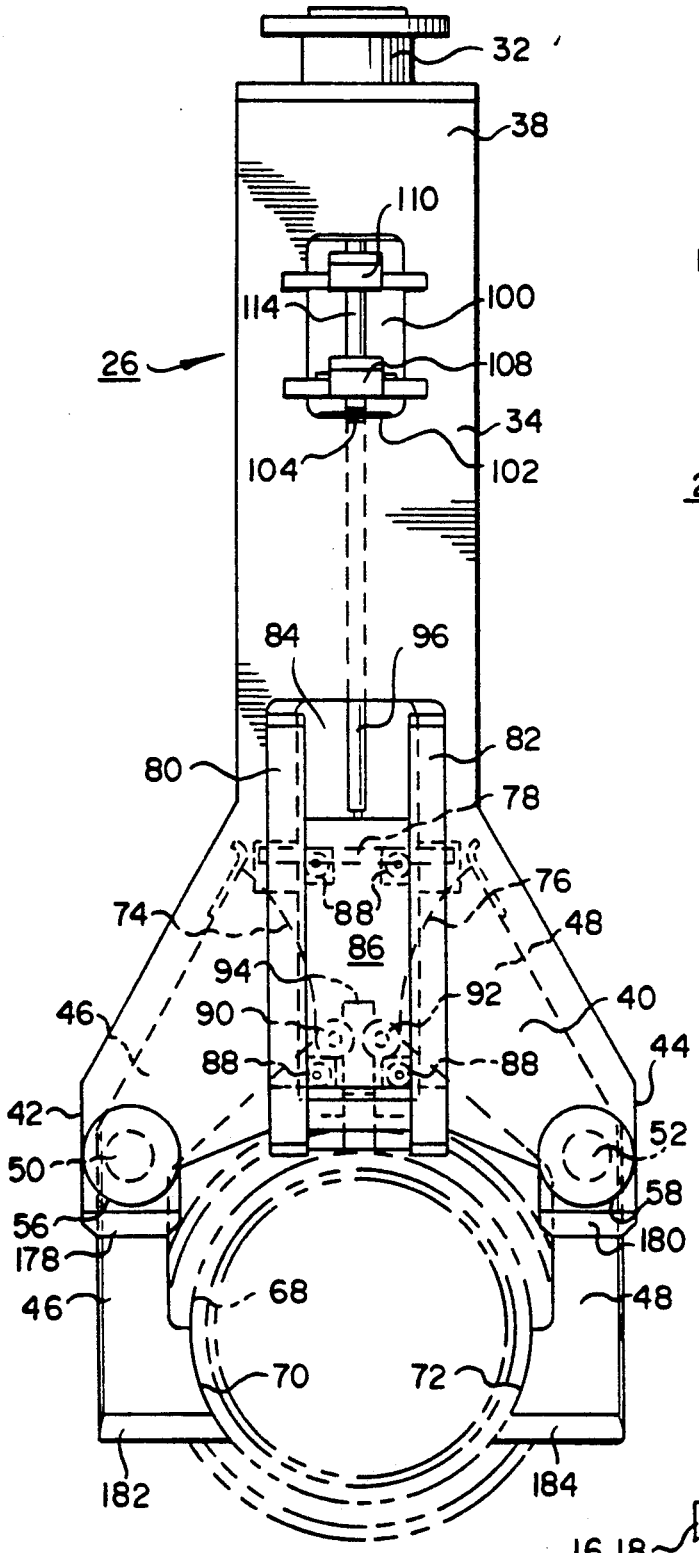
FIG. 3 illustrates a front elevation view of a tool according to the invention, indicating in phantom lines how the tool grasps the end hubs of the hollow core of a roll of web material.
Figure 4:
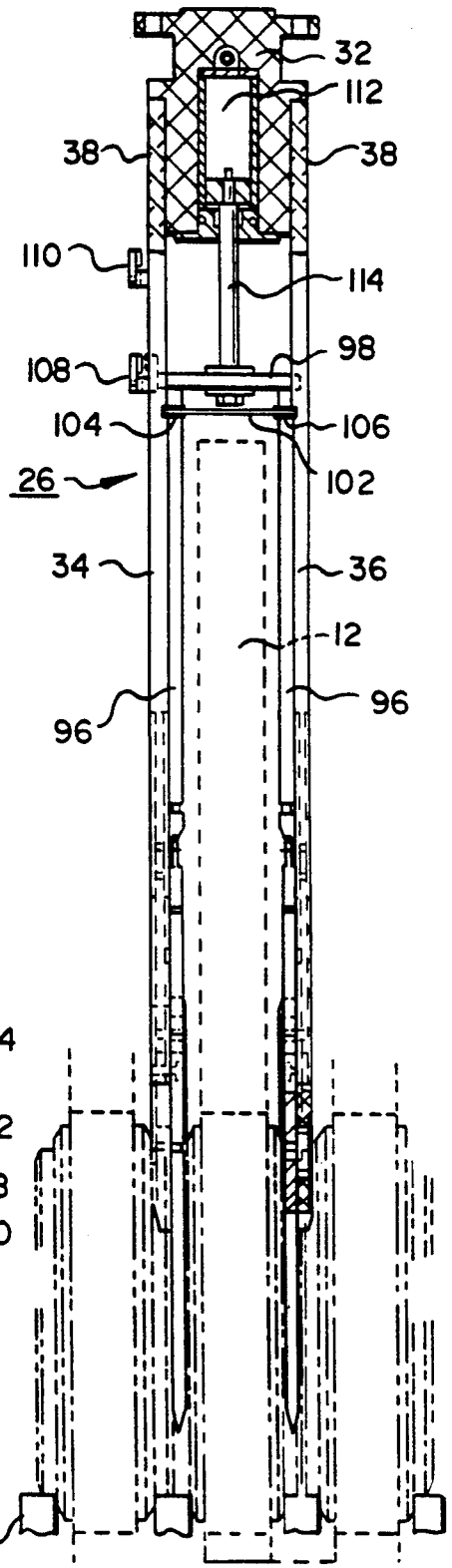
FIG. 4 illustrates a side elevation view, partially broken away and partially in phantom lines, as seen from the right in FIG. 3.
Figure 5:
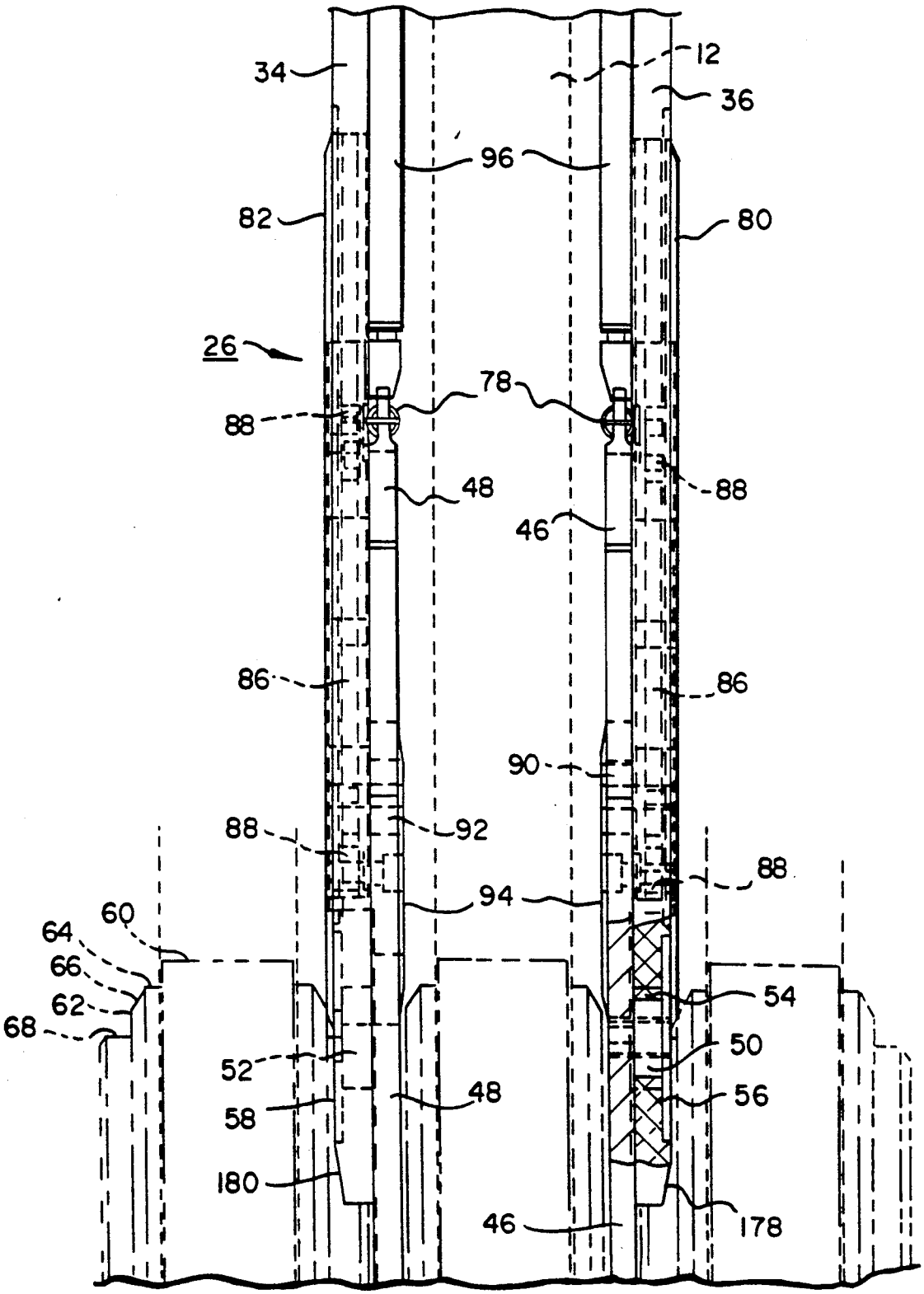
FIG. 5 illustrates an enlarged, fragmentary view of the central portion of FIG. 4.

In an adjacent work space separated from rack 10 by a partition 20 is located a general purpose programmable robot 22, such as a Model IRB-3000 made by Asea Brown Boveri. Partition 20 may be used to isolate photographic film on rack 10 from robot 22 in the event that lights must be used to service robot 22 or other equipment on that side of the partition. Robot 22 is provided with a wrist 24 which supports the unique end effector or tool 26 of the invention as illustrated in FIGS. 3 to 5. By suitable conventional programming techniques, robot 22 is enabled to use tool 26 to grip and then lift a roll 12 from rack 10, carry the roll through a suitable opening in partition 20 and then place the roll on the chuck of a transfer stand 28, shown schematically in FIG. 2, which preferably is of the type illustrated in FIGS. 6 to 9. Transfer stand 28 is positioned with its chuck opposite and axially aligned with a similar chuck of a processing apparatus 30 such as a film perforator, as illustrated schematically in FIGS. 1, 2 and 9.

In operation of the overall apparatus of FIGS. 1 and 2, rack 10 is loaded with rolls 12 and positioned within reach of robot 22. Assuming that there is no roll 12 on the chuck of processing apparatus 30, robot 22 moves tool 26 down over any one of the rolls on rack 10 and actuates tool 26 to grip the roll, which is then lifted from rack 10 and placed on the chuck of transfer stand 28. Robot 22 then deactuates tool 26 to release the first roll and moves away to a neutral position. As will be discussed subsequently, transfer stand 28 is then actuated to extend its chuck toward the chuck of processing apparatus 30, after which the roll is pushed axially from the chuck on transfer stand 28 onto the chuck of processing apparatus 30. The chuck of transfer stand 28 is then withdrawn. While the first roll is being transferred and then processed, robot 22 returns tool 26 to rack 10 for the second roll which is then placed on the chuck of transfer stand 28. After releasing the second roll, robot 22 positions tool 26 over the first roll being unwound by processing apparatus 30 and waits. If the first roll is being rewound at another location on processing apparatus 30, robot 22 will remove the empty core of the first roll and return the empty core to rack 10 while the second full roll is transferred from transfer stand 28 to processing apparatus 30. Alternatively, if the first roll is to be rewound at the same location after processing, robot 22 will remove the processed first roll and return it to rack 10 while the second full roll is transferred. This sequence then repeats until all of the rolls on rack 10 have been processed, following which a rack of fresh rolls is brought into position.

FIGS. 3 to 5 illustrate the details of tool 26, with the various elements of the tool shown in their positions to grip the core of a roll 12. The opposite side of tool 26 from that shown in FIG. 3 is essentially identical in structure, as indicated in FIGS. 4 and 5. A top block 32 is provided which is configured in the conventional manner for mechanical attachment to wrist 24. Rigidly attached to and extended downwardly from top block 32 are first and second essentially identical side frames or plates 34,36 each having an upper end 38 and a Y-shaped lower end 40 with laterally spaced legs 42,44. Side frames 34,36 extend essentially parallel to each other to define between them an elongate space for receiving a roll 12. Near the lower ends of legs 42,44 and between side frames 34,36 are mounted two pairs of opposed gripper arms 46,48, one pair 46,48 on each side frame. Gripper arms 46,48 are shown partially in phantom in FIG. 3 for ease of illustration and are pivotably supported by pivot shafts 50,52 mounted in suitable plain bearings 54 fitted to legs 42,44 and secured by thrust washers 56,58, as shown in FIG. 5.

As indicated in FIGS. 3 to 5, gripper arms 46,48 are adapted to grip a hollow core 60 of each roll 12, core 60 being illustrated in phantom. Core 60 may be machined from a suitable material such as phenolic tubing and is provided at each end with a stepped hub 62 which extends axially beyond the ends of roll 12. Hub 62 preferably includes an outer, circumferentially extending land 64 which merges with a lead in chamfer 66 that helps guide tool 26 into proper engagement with core 60. Radially inwardly from chamfer 66 is an inner, circumferentially and axially extending land 68 which is engaged by gripper arms 46,48. Land 68 also serves to position the film wound on the core at the proper axial distance from adjacent rolls in rack 10 or from adjacent equipment such as transfer stand 28 or processing apparatus 30. The lower ends of gripper arms 46,48 are positioned below legs 42,44 sufficiently far to enable circularly cylindrical gripping surfaces 70,72 on the gripper arms to engage land 68 when tool 26 is seated on a roll 12, in a manner to be described. Preferably, the diameter of gripping surfaces 70,72 is substantially equal to the diameter of land 68.

On the opposite side of pivot shafts 50,52 from gripping surfaces 70,72, gripper arms 46,48 are angled respectively toward the centerline of side frames 34,36 and provided with curved cam surfaces 74,76 whose radius of curvature from pivot shafts 50,52 decreases as the cam surfaces near the centerline of the side frames. At their upper ends, gripper arms 46,48 are connected by a tension spring 78 which resiliently biases the gripper arms to pivot gripping surfaces 70,72 out of their illustrated positions of engagement with land 68 and to hold cam surfaces 74, 76 in contact with cam followers in an actuator mechanism for tool 26. To cause gripping surfaces 70,72 to engage land 68, each side frame and pair of gripper arms is provided with an actuator mechanism which comprises a pair of opposed linear tracks 80,82 which are mounted in parallel on the sides of an essentially rectangular opening 84 provided in each side frame. Positioned between tracks 80,82 is a slide or carriage plate 86 having mounted on its side facing roll 12 two pairs of small wheels 88, illustrated in phantom, which ride in tracks 80,82. On the same side of carriage plate 86 is mounted a pair of cam follower rollers 90,92 against which cam surfaces 74,76 are pressed due to the force of tension spring 78. At its lower end near land 68, each carriage plate 86 supports an axially extending clamp mandrel 94, preferably provided with a cushioned end to engage land 68, which contacts land 68 just as gripping surfaces 70,72 come into full engagement with land 68. At its opposite end, each carriage plate 86 is attached to an axially extending actuator rod 96 which extends upwardly along the inside surface of the associated side frame 34,36. The two actuator rods 96 are connected at their upper ends by a cylinder actuator plate 98. Each of side frames 34,36 is provided with an opening 100 and between the lower edges of openings 100 is positioned a mounting plate 102 which supports a pair of guide bushings 104,106 for actuator rods 96. Also mounted at opening 100 on either of side frames 34,36 are upper and lower limit switches 108,110 which respond to the passage of actuator plate 98 to provide signals indicative of the condition of tool 26. Finally, a pneumatic cylinder 112 is provided within top block 32 and its rod 114 is connected to actuator plate 98.

To open tool 26 from its fully engaged position as shown in FIG. 3, cylinder 112 is actuated to pull rod 114 upwardly as illustrated, thereby moving carriage plate 86 and cam followers 90,92 upwardly. Due to the force of springs 78, gripper arms 46,48 pivot toward one another at their upper ends, thereby moving gripping surfaces 70,72 out of engagement with land 68. Robot 22 can then withdraw tool 26. When tool 26 is to be positioned over a roll 12, robot 22 guides the tool over the roll until the center line of tool 26 coincides with the center line of core 60. Chamfers 178, 180, 182, and 184 provide guiding in case of slight misalignment between tool 26 and roll 12. Then, cylinder 112 is actuated to extend rod 114 downwardly, thereby moving carriage plate 86 and cam followers 90,92 downwardly. As carriage plate 86 moves downwardly, cam followers 90,92 engage cam surfaces 74,76 and the force of springs 78 is overcome to pivot gripper arms 46,48 toward one another at their lower ends, thereby moving gripping surfaces 70,72 into firm engagement with land 68. Just as gripping surfaces 70,72 engage land 68 in the position illustrated in FIG. 3, clamp mandrel 94 on each carriage plate also engages land 68, thereby securely gripping and preventing tipping of roll 12 during transport by robot 22.

After robot 22 has picked up a roll 12 from rack 10, the roll is placed on the chuck of transfer stand 28, as illustrated in FIGS. 6 to 9. A base or stand 116 supports a base plate 118 on the upper surface of which are positioned four pillow blocks 120 in a rectangular pattern, only three of the pillow blocks being visible in the Figures. A pair of parallel slide rods 124,126 are slidably mounted in respective pairs of pillow blocks 120. The ends of rods 124,126 are attached to respective pairs of hangers 128 which are mounted in a rectangular pattern on the underside of a bracket base plate 130. Mounted on base plate 118 below base plate 130 is a pneumatic actuator cylinder 132 whose rod 134 extends and is connected to a centrally positioned connector bar 136 extended downwardly from base plate 130. Due to this arrangement, extension of rod 134 from cylinder 132 causes base plate 130 to move from the position of FIGS. 6 and 7 to that of FIG. 9, and vice versa.

Figure 8:
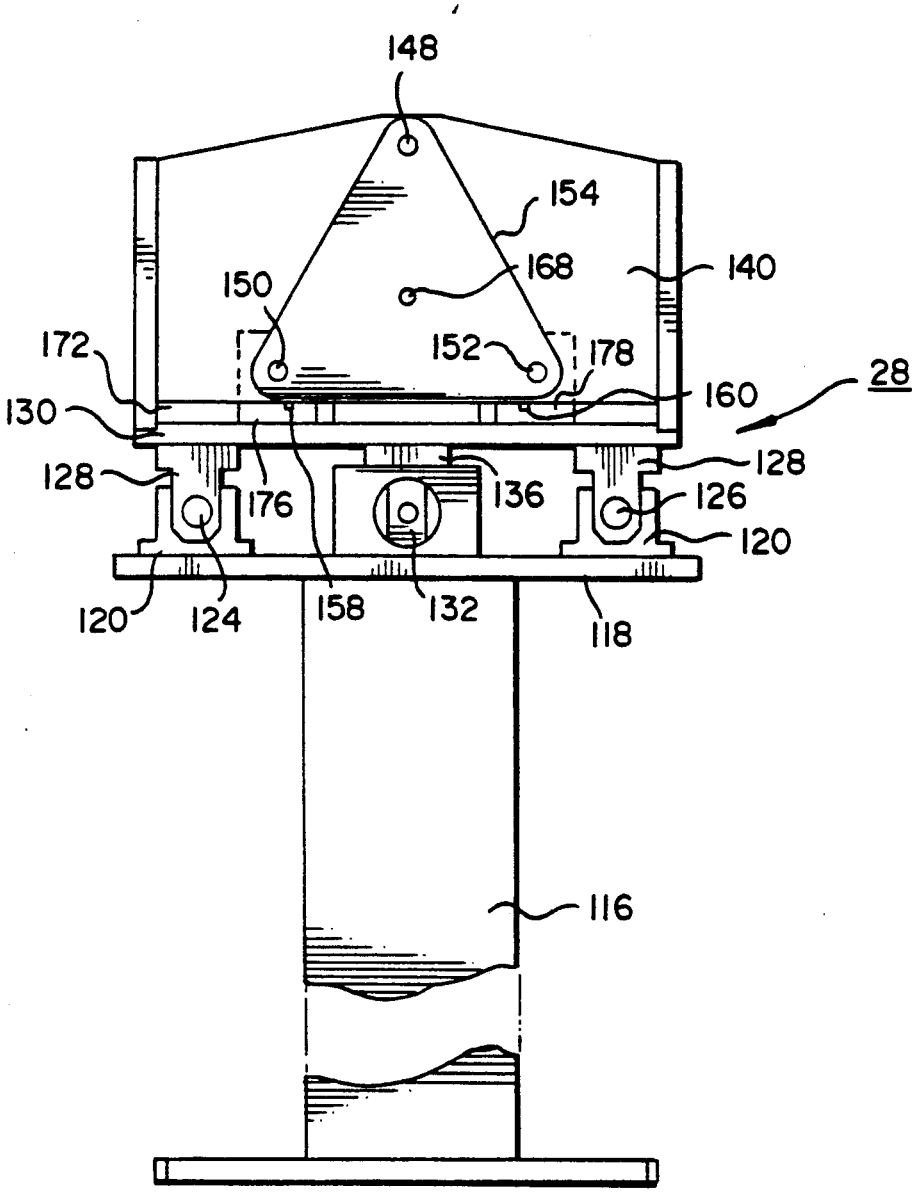
FIG. 8 illustrates an end elevation view as seen from the right in FIG. 6.
Figure 9:
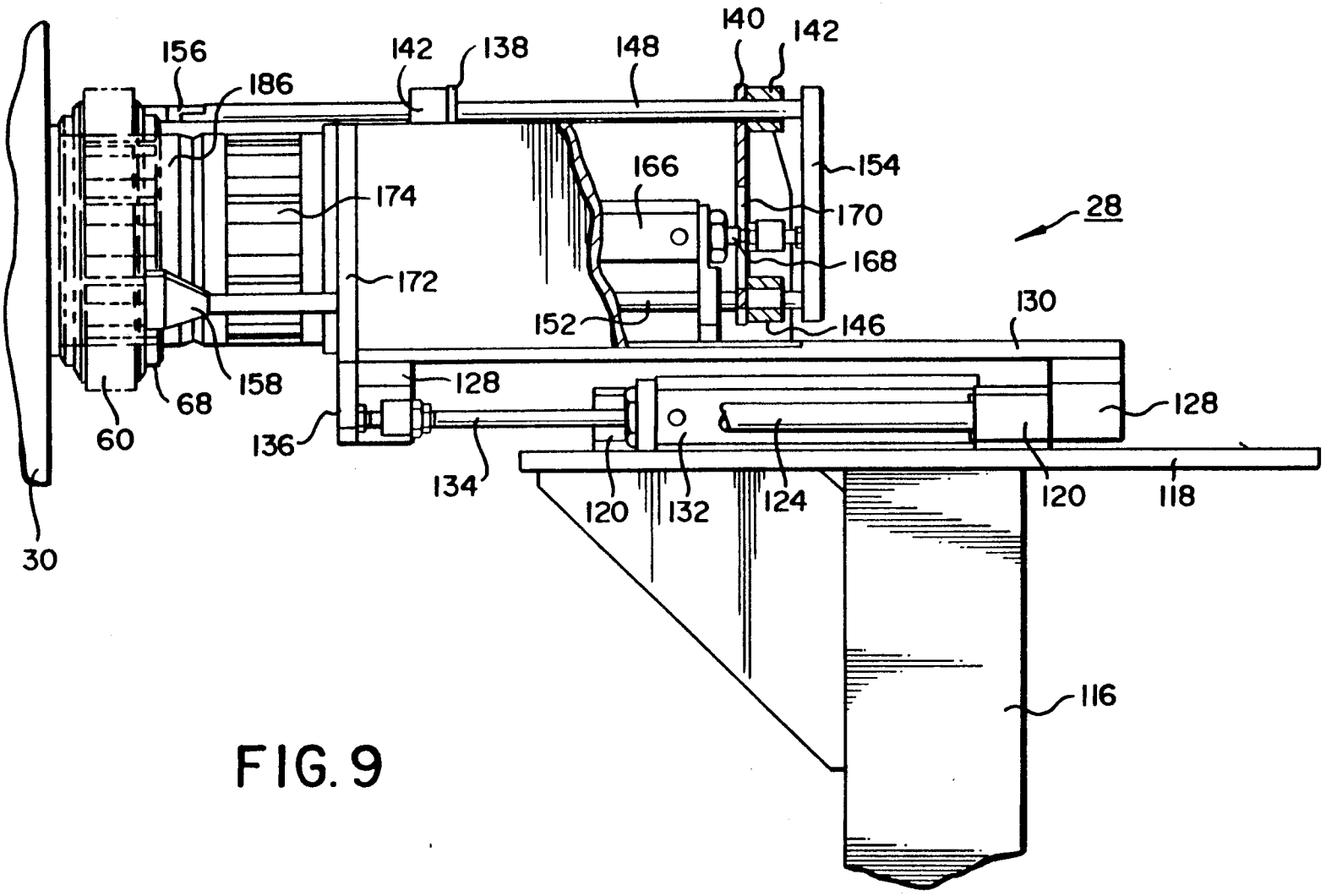
FIG. 9 illustrates a side elevation view, partially fragmentary and partially broken away, of the roll transfer station of FIG. 6, with the roll supporting chuck in its fully extended position and the roll pushed onto an axially aligned chuck of an adjacent apparatus.

A pair of transverse slide bracket plates 138,140 are mounted essentially perpendicular to the upper surface of base plate 130. Each bracket plate 138,140 supports an essentially equilateral triangular array of linear bushings or bearings 142,144,146 through which are slidably mounted push rods 148,150,152. At one end, the push rods are connected to a triangular connector plate 154 and at the other end, each push rod carries one of push bars 156,158,160. The undersurface 162 of each push bar is positioned tangent to a circle just slightly larger than the diameter of land 68. A cylinder bracket 164 is attached to base plate 130 to support a pneumatic actuator cylinder 166 whose rod 168 extends through an opening 170 in bracket plate 140 and is connected to rod connector plate 154. A front plate 172 extends upwardly from base plate 130 and supports a conventional air chuck 174 whose axis is coincident with the tangent circle of push bars 156,158,160. The upper most push bar 156 is positioned to pass over the upper edge of front plate 172, while push bars 158,160 extend through openings 176,178 in front plate 172, as best seen in FIG. 8. As shown in FIG. 9, air chuck 174 is mounted coaxially with and faces toward the conventional air chuck 186 of processing apparatus 30, on which rolls 12 are to be positioned for processing.

Figure 6:
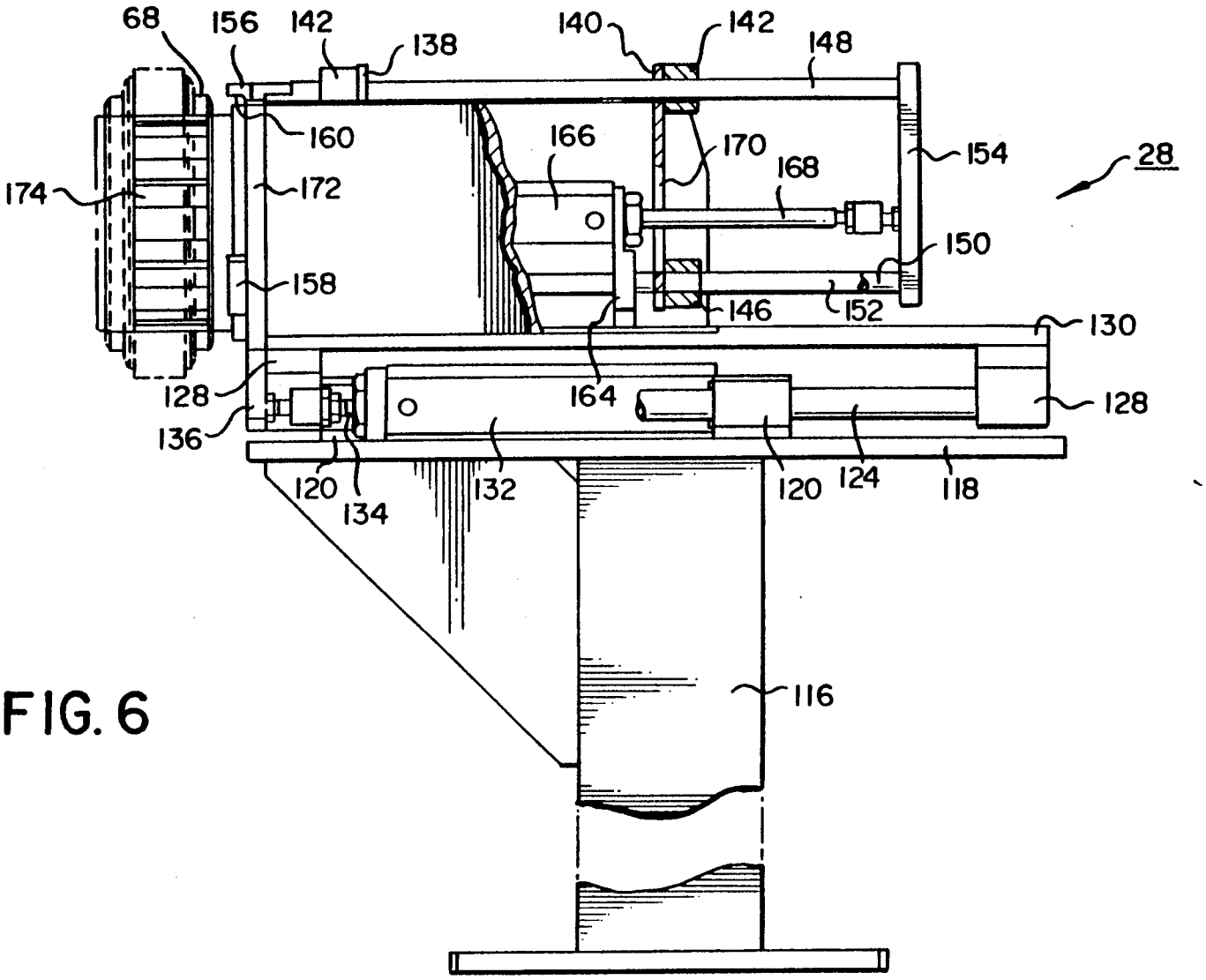
FIG. 6 illustrates a side elevation view, partially broken away, of a roll transfer station according to the invention, with the roll supporting chuck in its fully retracted position.
Figure 7:
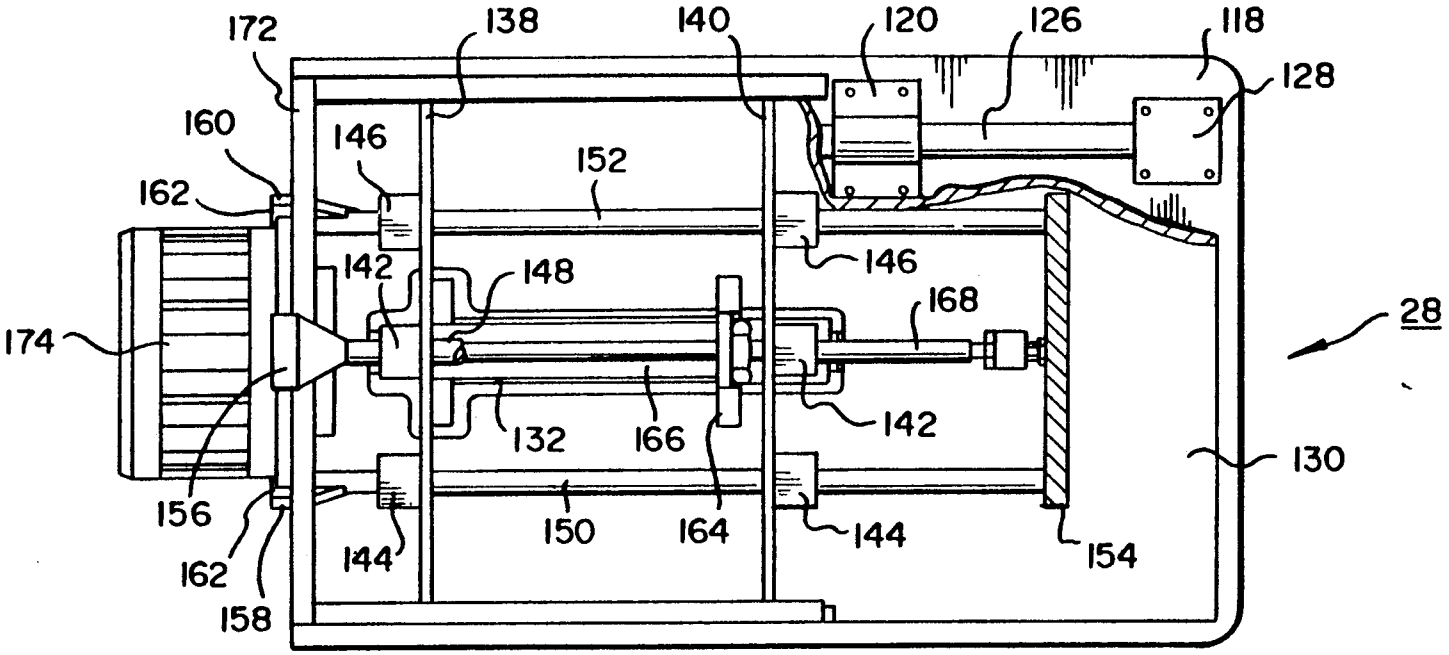
FIG. 7 illustrates a top view, partially broken away, of the roll transfer station of FIG. 6.

In operation of transfer stand 28, a roll 12 is positioned by robot 22 on chuck 174 in the position of FIGS. 6 and 7. When the preceding roll 12 or core 60 has been removed from chuck 186 on processing apparatus 30, cylinder 132 is operated to move base plate 130 to the position of FIG. 9, at which chucks 174 and 186 nearly abut. Then, cylinder 166 is operated to extend push bars 156,158,160 into engagement with core 60, thereby pushing the roll 12 from chuck 174 onto chuck 186. Cylinder 166 then retracts the push bars and cylinder 132 returns transfer stand 28 to the position of FIGS. 6 and 7 to await the next roll 12.

The apparatus of the invention permits fast, safe, precise handling of much larger rolls of film than could previously be handled manually. The use of the programmable robot and tool permits movement of such large rolls between racks and transfer or processing stands which are spaced a considerable distance from each other, thereby permitting rather flexible positioning of the roll storage and roll processing equipment, since the programming of the robot can readily account for the positions of the other components of the system. The cores of the rolls are configured at their end hubs to cooperate with the support rack, with the transfer tool, with the transfer stand and with the processing apparatus, to ensure safe, precise handling and processing of such larger rolls.

While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure Letters Patent for:

1. Apparatus for handling rolls of web material, said rolls being of the type comprising a hollow core on which a length of said web material is wound, said core having an axis of rotation and opposite ends, each end having a radially outwardly facing circumferential land extending axially beyond said material, said apparatus comprising:

means for supporting a plurality of said rolls;

a first stand having a first chuck for engagement within said hollow core, said first chuck having a first longitudinal axis;

a second stand having a second chuck for engagement within said hollow core, said second chuck having a second longitudinal axis coincident with said first longitudinal axis, said second chuck being spaced from and oriented toward said first chuck;

means for gripping a roll on said means for supporting by engaging said radially outwardly facing circumferential lands of said core and for placing a roll on said first chuck; and means for transferring a roll from said first chuck to said second chuck.

2. Apparatus according to claim 1, wherein said means for gripping and placing comprises a programmable robot having a tool for gripping a roll, said robot being effective to lift a roll gripped by said tool from said means for supporting and to place a roll gripped by said tool on said first chuck.

3. Apparatus for handling rolls of web material, said rolls being of the type comprising a hollow core on which a length of said web material is wound, said core having an axis of rotation and opposite ends, each end extending axially beyond said material, said apparatus comprising:

means for supporting a plurality of said rolls;

a first stand having a first chuck for engagement within said hollow core, said first chuck having a first longitudinal axis;

a second stand having a second chuck for engagement within said hollow core, said second chuck having a second longitudinal axis coincident with said first longitudinal axis, said second chuck being spaced from and oriented toward said first chuck;

means for gripping a roll on said means for supporting by engaging said ends of said core and for placing a roll on said first chuck, said means for gripping and placing comprising a programmable robot having a tool for gripping a roll, said robot being effective to lift a roll gripped by said tool from said means for supporting and to place a roll gripped by said tool on said first chuck;

said tool comprising first and second elongated side frames each having an upper and a lower end; means connected between said upper ends for defining an elongate space between said side frames; a first pair of opposed gripper arms pivotably mounted to said lower end of said first side frame and a second pair of opposed gripper arms pivotably mounted to said lower end of said second side frame, each said gripper arm of each said pair comprising a surface for engaging said end of said core; means for resiliently biasing said gripper arms to pivot and move said surfaces out of engagement with said core; first and second actuator means, mounted on respective ones of said first and second side frames, for forcing said gripper arms to pivot and move said surfaces into engagement with said core; means, mounted to said first and second side frames, for simultaneously operating said first and second actuator means; and means connected with said side frames for joining said tool to said robot; and means for transferring a roll from said first chuck to said second chuck.

4. Apparatus according to claim 3, wherein each said gripper arm of each said pair comprises a cam surface and said first and second actuator means each comprises;

a pair of guide tracks mounted on the respective side frame;

a carriage mounted for movement along said guide tracks under the influence of said means for simultaneously operating; and first and second cam followers mounted on said carriage, each of said cam followers engaging said cam surface on a respective one of said gripper arms.

5. Apparatus according to claim 4, further comprising means mounted on said carriage for engaging said core when said surfaces of said gripper arms engage said core.

6. Apparatus according to claim 3, wherein said means for simultaneously operating comprises:

first and second actuator rods, each said rod having a lower end and an upper end, each lower end being attached to a respective one of said first and second actuator means so that each said rod extends toward said means for defining;

an actuator element connecting said first and second actuator rods at said upper ends; and cylinder means, operatively connected between said means for defining and said actuator element, for moving said adaptor element and said rods to operate said first and second actuator means.

7. Apparatus according to claim 3, wherein said surface of each said gripper arm engages the exterior surface of a respective one of said ends.

8. Apparatus for handling rolls of web material, said rolls being of the type comprising a hollow core on which a length of said web material is wound, said core having an axis of rotation and opposite ends, each end extending axially beyond said material, said apparatus comprising:

means for supporting a plurality of said rolls;

a first stand having a first chuck for engagement within said hollow core, said first chuck having a first longitudinal axis;

a second stand having a second chuck for engagement within said hollow core, said second chuck having a second longitudinal axis coincident with said first longitudinal axis, said second chuck being spaced from and oriented toward said first chuck;

means for gripping a roll on said means for supporting by engaging said ends of said core and for placing a roll on said first chuck; and means for transferring a roll from said first chuck to said second chuck, said means for transferring comprising a support bracket; means for mounting said support bracket on said first stand for movement parallel to said first longitudinal axis; means on said support bracket for supporting said first chuck; means on said first stand for moving said support bracket parallel to said first longitudinal axis to position said first and second chucks in close proximity and thereby permit axial movement of a roll from said first chuck onto said second chuck; and means on said support bracket for pushing on said core to move a roll axially from said first chuck onto said second chuck.

9. Apparatus according to claim 8, wherein said means for pushing comprises:

a plurality of parallel pusher bars having ends for engaging said core, said core being mounted on said first chuck;

means for mounting said pusher bars on said support bracket for movement parallel to said first longitudinal axis; and means on said support bracket for moving said pusher bars to push on said core and thereby move a roll from said first chuck onto said second chuck.

10. Apparatus according to claim 9, wherein there are three of said pusher bars positioned to contact said core at circumferentially spaced locations on said core.

11. A tool for handling objects having an axis and opposite ends, each end having a hub extending axially beyond said end, said tool comprising:

first and second elongated side frames each having an upper and a lower end;

means connected between said upper ends for defining an elongate space between said side frames;

a first pair of opposed gripper arms pivotably mounted to said lower end of said first side frame and a second pair of opposed gripper arms pivotably mounted to said lower end of said second side frame, each said gripper arm of each said pair comprising a cam surface and a surface for engaging one of said hubs;

means for resiliently biasing said gripper arms to pivot and move said surfaces out of engagement with said hubs;

first and second actuator means, mounted on respective ones of said first and second side frames, for forcing said gripper arms to pivot and move said engaging surfaces into engagement with said hubs, each of said actuator means comprising a pair of guide tracks mounted on the respective side frame; a carriage mounted for movement along said guide tracks; and first and second cam followers mounted on said carriage, each of said cam followers engaging said cam surface on a respective one of said gripper arms; and means, mounted to said first and second side frames, for simultaneously operating said first and second actuator means by moving said carriage along said guide tracks.

12. Apparatus according to claim 11, further comprising means mounted on said carriage for engaging said hub when said engaging surfaces of said gripper arms engage said core.

13. A tool for handling objects having an axis and opposite ends, each end having a hub extending axially beyond said end, said tool comprising:

first and second elongated side frames each having an upper and a lower end;

means connected between said upper ends for defining an elongate space between said side frames;

a first pair of opposed gripper arms pivotably mounted to said lower end of said first side frame and a second pair of opposed gripper arms pivotably mounted to said lower end of said second side frame, each said gripper arm of each said pair comprising a cam surface and a surface for engaging one of said hubs;

means for resiliently biasing said gripper arms to pivot and move said gripper arms into contact with said cam surface and said engaging surfaces out of engagement with said hubs;

first and second actuator means, mounted on respective ones of said first and second side frames, for forcing said gripper arms to pivot and move said engaging surfaces into engagement with said hubs; and means, mounted to said first and second side frames, for simultaneously operating said first and second actuator means, said means for simultaneously operating comprising first and second actuator rods, each said rod having a lower end and an upper end, each lower end being attached to a respective one of said first and second actuator means so that each said rod extends toward said means for defining; an actuator element connecting said first and second actuator rods at said upper ends; and cylinder means, operatively connected between said means for defining and said actuator element, for moving said adaptor element and said rods to operate said first and second actuator means.

* * * * *